United States Patent [19]

Witmer et al.

[11] 4,072,889

[45] Feb. 7, 1978

[54] ELECTRONICALLY STABILIZED FEEDER DEVICE FOR THE SUPPLY OF DC CURRENT

[75] Inventors: Kurt Witmer, Zollikon; Roland Cachin, Zurich, both of Switzerland

[73] Assignee: Dr. K. Witmer Elektronik AG, Erlenbach, Switzerland

[21] Appl. No.: 719,926

[22] Filed: Sept. 2, 1976

[30] Foreign Application Priority Data

Sept. 3, 1975 Switzerland ..... 11391/75

[51] Int. Cl.[2] ..... G05F 1/58; G05F 1/62; G05F 1/64

[52] U.S. Cl. ..... 323/9; 323/20; 323/25; 323/43.5 S; 363/85

[58] Field of Search ..... 323/20, 21, 23, 25, 323/43.5 S, 45, 9; 363/68, 85, 86, 89

[56] References Cited

U.S. PATENT DOCUMENTS 3,921,059 11/1975 Birman et al. ..... 323/25 X

*Primary Examiner*—A. D. Pellinen

*Attorney, Agent, or Firm*—James E. Nilles

[57] ABSTRACT

An electronically stabilized feeder device for supplying regulated DC current to a load includes circuitry for adjusting the load voltage to a selected value, circuitry for adjusting the load current to a selected value, and circuitry responsive to load current to limit load voltage and thereby limit the power supplied to the load to the selected value and to reduce load voltage to its lowest value regardless of selected values in the event of a short circuit.

21 Claims, 3 Drawing Figures

ELECTRONICALLY STABILIZED FEEDER DEVICE FOR THE SUPPLY OF DC CURRENT

Figure 1:
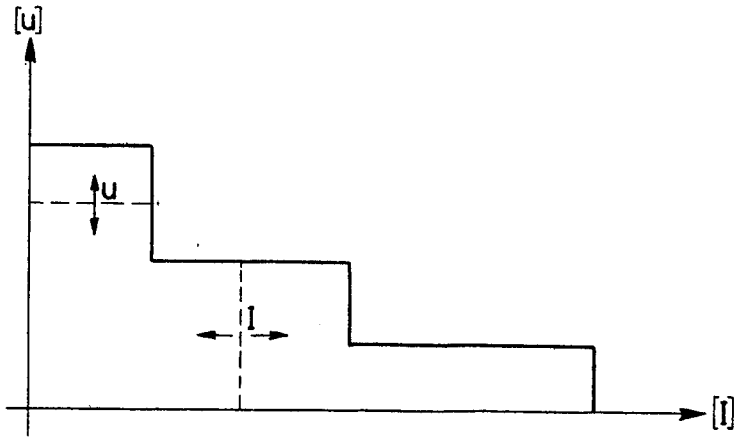

This invention concerns an electronically stabilized feeder device for the supply of DC current.

Today, electronically stabilized feeder devices for laboratory use mostly work with automatic transition from voltage stabilization to current stabilization, i.e. their output voltage as a function of the output current describes a rectangular curve.

Commonly, the voltge as well as the current can be adjusted continuously from zero to a maximum value.

In devices with a maximum output of 50 to 100 W a presetting is generally not used for economic reasons, so that in case of a short circuit the whole power is dissipated to heat in the device.

Thus, the longitudinal transistors and their cooling elements normally used for stabilization must be dimensioned for this maximum output power.

A device for an output voltage of 0 to 30 V and an output current of 0 to 1 A must be dimensioned for 30 W, just as a device for 0 to 15 V output voltage and 0 to 2 A output current, or a device for 0 to 7.5 V and 0 to 4 A.

Thus there are devices which can be switched manually to two or more ranges with the same maximum output power.

Besides switching over the unstabilized voltage, the maximum current limit must also be switched.

There are known devices where the switching of the unstabilized voltage is done automatically.

However, these devices have the disadvantage that, at the corresponding output voltage, the current range must be switched manually in order to obtain the respective maximum output power.

This invention is characterized by the fact that means are used in order to shape the output characteristic curve in the U-I diagram stair-shaped, in such a way that the device produces the full permissible output in every range and cannot be overloaded.

In accordance with the invention, an electronically stabilized feeder device for supplying direct current to a load through a load circuit comprising: power supply means for supplying DC in at least one voltage range to said load circuit; regulating means connected at least partly serially in the load circuit; control selecting means connected to operate the regulating means; an adjustable load current controlling means connected to the control selecting means, the load current controlling means operating to maintain current in the load circuit at a selected predetermined value; an adjustable load voltage controlling means connected to the control selecting means, the load voltage controlling means operating to maintain voltage in the load circuit at a selected predetermined value; and power controlling means connected to the control selecting means, the power controlling means being responsive to load current in the load circuit; the control selecting means effecting operation of the regulating means when the power controlling means senses that current in the load control circuit has exceeded said predetermined value to change the load voltage and thereby limit the maximum power level supplied to the load.

The power supply means is operative in response to the adjustable load voltage controlling means to supply DC in a plurality of different voltage ranges and to provide a predetermined maximum power level in each range.

The power controlling means is further connected to the power supply means and operates in response to a short circuit in the load circuit to change the voltage range to said lowest range and thereby reduce power to the load to thereby protect the device against overload damage.

A sample design of the invention is explained by means of illustrations.

Figure 2:
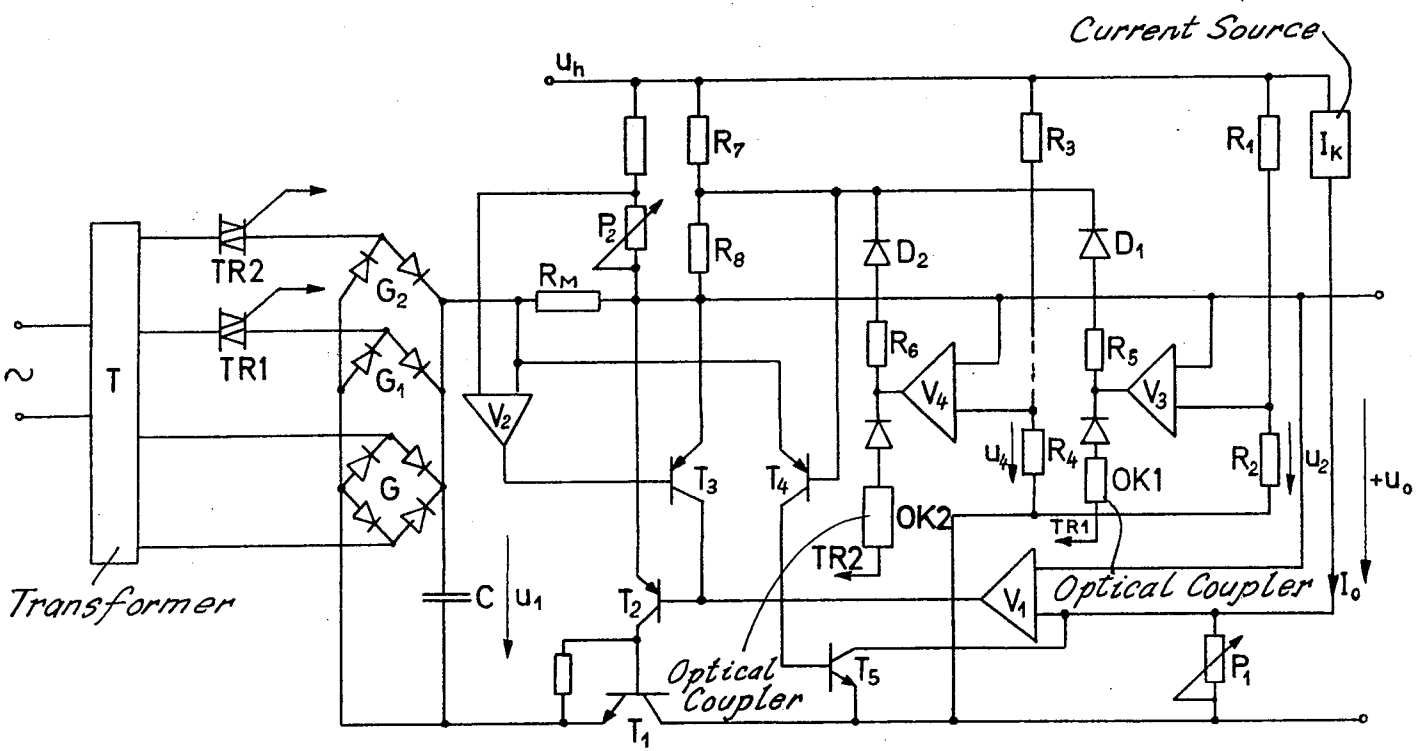
Figure 3:
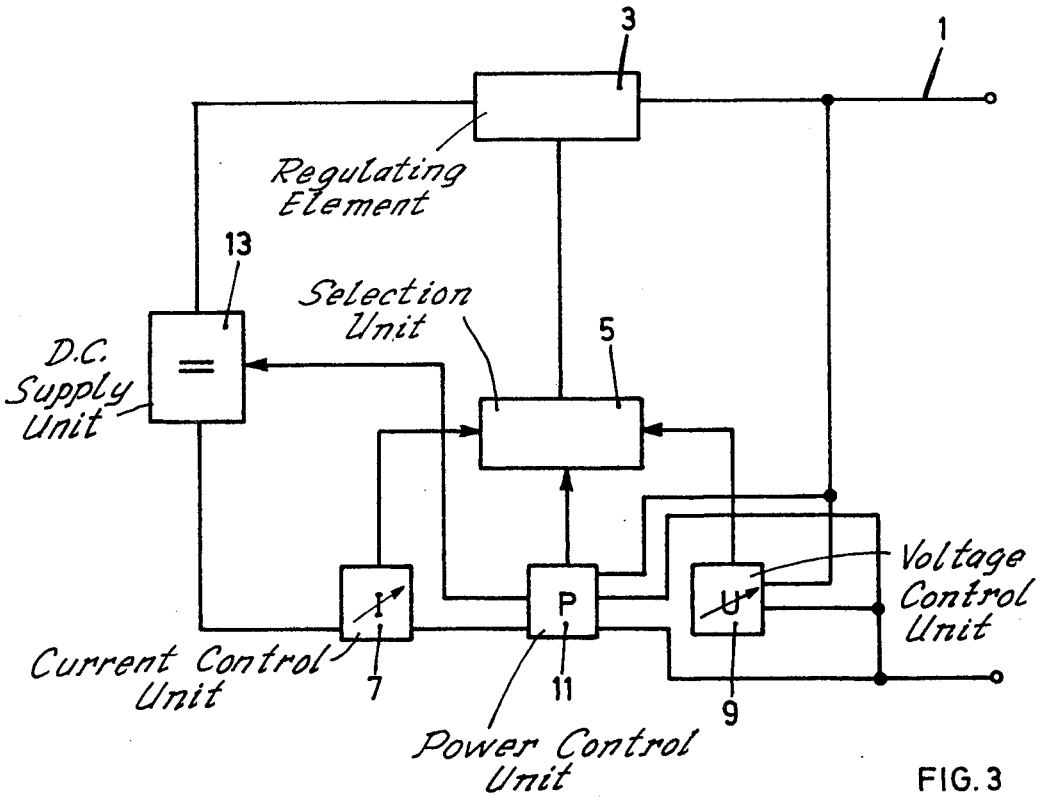

The illustrations show:

FIG. 1 an example of the output characteristic curve of the feeder device as per the invention;

FIG. 2 a network embodiment for the automatic switching of a voltage and current limits to create an output characteristic curve as per FIG. 1;

FIG. 3 a functional block diagram of a feeder device as per the invention.

The main circuit as per FIG. 2 consists of transformer T, the rectifiers G, $G_1$, $G_2$, the capacitor C and the power transistor $T_1$.

The voltage regulation is conventional: the voltage across a potentiometer $P_1$, created by a highly constant reference current $I_o$ — furnished by a current source $I_k$ — is compared with the output voltage $+U_o$ by a voltage amplifier $V_1$. The voltage amplifier controls the power transistor $T_1$ via the base of the driver transistor $T_2$. Since the differential voltage between the inputs of the amplifier $V_1$ strives toward zero, an output voltage occurs corresponding to the voltage across the potentiometer $P_1$. The reference current source $I_k$ is fed with a positive auxiliary voltage $U_h$ of, i.e., 15 V, which is fixed with respect to $+U_o$. The voltage is regulated via an amplifier $V_2$, which compares the voltage created across a measuring resistor $R_M$ by the load current with the voltage across the potentiometer $P_2$ and controls the series power transistor $T_1$ via the transistor $T_3$ and the driver transistor $T_2$.

The unstabilized supply voltage $U_1$ across the condenser C is switched on the basis of the comparison of reference voltages with the output voltage $+U_o$.

The differing reference voltages $U_4$ and $U_2$ are created by means of the voltage divider $R_3/R_4$, $R_1/R_2$ resp., and are respectively fed to an input of voltage comparators $V_3$ resp. $V_4$.

If the output voltage $+U_o$ is increased by means of the potentiometer $P_1$ and reaches, for example, the value of the reference voltage $U_2$, the corresponding voltage comparator $V_3$ controls the Triac TR1 via the optocoupler OK1 in such a way that it becomes conductive; thus, a transformer voltage corresponding to the switched on transformer tab is rectified by the rectifier $G_1$, and provide an according DC-voltage at the capacitor.

If the output voltage $U_o$ is further increased and reaches the value of the reference voltage $U_4$, the voltage comparator $V_4$ switches on the next transformer tab via the optocoupler OK2 and the Triac TR2. In turn, an according DC-voltage is provided to the capacitor C, by the rectifier $G_2$.

Conversely, when the output voltage $U_o$ is decreased, and drops below the reference voltages, the corresponding transformer tabs are switched off.

If, at a fixed output voltage $+U_o$, the load current through a measuring resistor $R_M$ reaches such a value that the resulting voltage thereacross reaches that value of the voltage set by means of the current limiting potentiometer $P_2$, the output voltage of the amplifier controls the power transistor $T_1$ via the transistor $T_3$ and the driver transistor $T_2$ in such a way that it becomes less conductive and consequently the load current can no longer increase. If, on the other hand, the sum of the voltage across the measuring resistor $R_M$ and a resistor $R_8$ reaches the value of the base emitter diode flow voltage of the transistor $T_4$, the latter turns the transistor $T_5$, to be more conductive so that part of the highly constant reference current $I_o$ is shunted through $T_5$, so that the voltage $P_1$ across the potentiometer and thus the output voltage $+U_o$ becomes smaller.

However, the voltage across $R_8$ is, on the one hand, dependent on the auxiliarly voltage $U_h$ and the resistors $R_7$ and $R_8$, and on the other hand of the output voltages of the voltage comparators $V_3$ and $V_4$ which are supplied to the resistor $R_8$ via the resistor $R_6$ and the diode $D_2$, resp. $R_5$ and $D_1$.

This shows that the current limit is, on the one hand, dependent on the load current through the measuring resistor $R_M$ and the setting of the current limiting potentiometer $P_2$, and on the other hand dependent on the load current through said measuring resistor $R_M$ and by means of the voltage comparators $V_3$ and $V_4$, the resistors $R_5$, $R_6$ and $R_8$ from the output voltage $+U_0$. Thus, the desired limiting of voltage and current as per FIG. 2 can be obtained by a suitable selection of the voltage dividers $R_3/R_4$, $R_1/R_2$ and the resistors $R_M$, $R_5$, $R_6$, $R_7$ and $R_8$.

FIG. 3 show a functional block diagram of the feeder device as per the invention, which will be described below with reference to the realization network shown in FIG. 2.

A regulating element 3 is placed in a load circuit, which element can be realized, by means of a controllable resistance, such as the transistor $T_1$ in FIG. 2.

The regulating element 3 is controlled by a selection unit 5, which, in turn, is controlled by a current control unit 7, a voltage control unit 9 and a power control unit 11; following certain criteria, the selection unit 5 selectively handles the regulating element control to one of the three above-mentioned units 7, 9, 11. According to FIG. 2, the selection unit 5 comprises the transistors $T_3$ and $T_4$. The control unit 7 is realized by means of the potentiometer $P_2$, the measuring resistor $R_M$, as well as the amplifier $V_2$. The voltage control unit 9 is realized by means of the potentiometer $P_1$, the current source $I_k$ and the amplifier $V_1$, whereas the power control unit II is attained with by means of the resistors $R_8$, $R_M$, and the amplifiers $V_3$, $V_4$ with their inpur and output circuits.

In the example of FIG. 2, the power control unit 11 with the elements described above acts on the voltage control unit 9 via the transistors $T_4$, $T_5$ the transistor, acting as a second regulating element. This is because the four amplifiers $V_1$, $V_{22}$, $V_3$ and $V_4$ are available as one integrated circuit, so that this arrangement results in especially compact circuit.

The power control unit 11 controls not only the adjusting element 3, but also a DC supply unit 13, which accordingly furnishes DC values variable in steps.

By means of the current control unit 7, accoding to FIG. 2, adjustable with $P_2$, a desired maximum current can be set; the desired output voltage 9 can be set with $P_1$.

Traditional devices with rectangular output characteristic curve must be dimensioned in such a way that at least the power, corresponding to the product of maximum setable current and maximum setable voltage, can be dissipated inside the device. In the circuit as per the invention, the power control unit 11 automatically alter the output voltage of the DC supply unit 13 and limits the maximum load current or the settable maximum output voltage (FIG. 1), respectively so that a specified maximum power of the device cannot be exceeded.

This voltage switching, resp. limiting, and the limiting of the then utmost permissible current has to occur exactly simultaneously, in order to avoid overloading of the device at any instance. Therefore, as shown in FIG. 2, the same active elements $V_3$, $V_4$ respectively, control either the available maximum current by the voltage supply unit the resistor $R_3$, or the switching of the DC supply unit via the respective Triacs, in each case limiting the maximum setable output voltage.

For the limitation of the respectively available maximum load current, $V_3+$ $V_4$ act as linear amplifiers via the diodes $D_1$ resp. $D_2$; for controlling the DC, supply unit they work as switcing elements vi the optocouplers OK1 and OK2 and the respective diodes, altering abruptly their output voltage. This is achieved by the fact that the amplifiers $V_3$, $V_4$ are either feedback coupled by the rsistor RPhd S or are working without feedback in the respective cases.

It is self-evident that the number of steps as per FIG. 1 can be increased if necessary by increasing the number of amplifiers in analogy to the amplifiers $V_3$, $V_4$, as well as by increasing the number of switchable output voltage steps of the DC supply unit.

By altering the output voltage of the DC supply unit the effectiveness of the device is considerably improved; however, these alterations are only possible in combination with automatic current limiting. It is further possible to operate the feeder device by remote control by mounting the two potentiometers $P_1$, $P_2$ remote from the feeder device.

We claim:

1. An electrically stabilized feeder device for supplying direct current to a load through a load circuit comprising:

power supply means for supply DC voltage to said load circuit;

regulating means connected at least partly seially in said load circuit;

control selecting means connected to operate said regulating means;

an adjustable load current controlling means connected to said control selecting means, said load current controlling means operating to limit the current to said load circuit to a selected predetermined value;

an adjustable load voltage controlling means connected to said control selecting means, said load voltage controlling means operating to maintain, under certain conditions, the load voltage at a selected predetermined value;

and power controlling means connected to said control selecting means, said power controlling means being responsive to output power, formed by the product of said current in said load circuit and of said load voltage;

said control selecting means effecting operation of said regulating means when said power controlling means senses a power which is at least approximately like a specified maximum power limit, to automatically alter either the load voltage value or the value of said current in the load circuit, in dependency of which of these values being externally set to ensure that the maximum power limit is not exceeded.

2. A feeder device according to claim 1 wherein said power supply means is operative to alter its output DC voltage, in response to said load voltage, to minimize internal voltage drops and, therefore, power dissipation.

3. A feeder device according to claim 1 wherein said load current controlling means comprises voltage comparator means for comparing a setable reference voltage to a load current dependent voltage.

4. A feeder device according to claim 3 wherein said voltage comparator means includes a difference amplifier connected to potentiometer means and resistance means serially connected in said load current circuit.

5. A feeder device according to claim 1 wherein said voltage controlling means comprises voltage comparator means for comparing a setable reference voltage to a voltage dependent on the device output voltage.

6. A feeder device according to claim 5 wherein said voltage comparator means comprises a difference amplifier connected to potentiometer means and to a device output, said potentiometer means being fed by a constant current source.

7. A feeder device according to claim 1 wherein said power controlling means comprises voltage comparator means for comparing at least one reference voltage to a voltage dependent on the device output voltage.

8. A feeder device according to claim 2 wherein said power supply is electronically switchable to alter its output voltage stepwise.

9. A feeder device according to claim 2 wherein said power controlling means comprises voltage comparator means for comparing at least one reference voltage to a voltage dependent on the device output voltage, the output voltage of said comparator means acting on the control selecting means as well as on the power supply means.

10. A feeder device according to claim 9 wherein said power controlling means comprises first voltage comparator means, said control selecting means comprising second voltage comparator means for comparing the output voltage of said first comparator means to a load current dependent voltage.

11. A feeder device according to claim 10 wherein said current controlling means comprises voltage comparator means for comparing a setable reference voltage to the load current dependent voltage.

12. A feeder device according to claim 10 wherein said second voltage comparator means controls said regulating means.

13. A feeder device according to claim 10 wherein said voltage controlling means comprises third voltage comparator means for comparing a setable reference voltage to a voltage dependent on the device output voltage, said regulating means comprising a controlled shunt element to shunt said setable reference voltage, said second voltage comparator means controlling said shunt element.

14. A feeder device according to claim 10 wherein said second voltage comparator means is a transistor.

15. A feeder device according to claim 13 comprising potentiometer means as the setting element for said reference voltage, and a transistor as shunt element, both being fed by a constant current source.

16. A feeder device according to claim 9 wherein said power controlling means comprises threshold level sensitive means connected to the output of the voltage comparator means to select, according to a comparison of the output voltage of said comparator means to the threshold level, whether said output voltage is being fed to the power supply means or to the control selection means.

17. A feeder device according to claim 16 wherein said power supply is switchable to alter its output voltage stepwise, the output voltage of the comparator means switching the power supply output voltage to higher level if applied thereto by the threshold sensitive means, said output voltage being fed alternately to the control selecting means.

18. A feeder device according to claim 17 wherein said power controlling means comprises first voltage comparator means, said control selecting means comprising second comparator means for comprising the output voltage of said first comparator means to a load dependent voltage, the output voltage of said first comparator means acting in opposition to said load dependent voltage on said second comparator means, said second comparator means controlling the regulating means for lower device output voltage limit and higher load current limit with rising of the output voltage of said first comparator means.

19. A feeder device according to claim 2 wherein said power control means comprises at least two voltage comparators with different reference voltages, the output voltages of said comparators acting additively on said control selecting means.

20. A feeder device according to claim 9 wherein said voltage comparator means is feedback coupled when its output is connected to said control selecting means, and is working with open loop when its output is connected to the power supply control.

21. A feeder device according to claim 16 wherein said threshold sensitive means comprises at least two serially connected diodes connected by a linking conductor, said linking conductor being connected to the comparator output at the cathode of one diode and the anode of the other.

* * * * *